US008171878B2

(12) United States Patent
Hayashi et al.

(10) Patent No.: US 8,171,878 B2
(45) Date of Patent: May 8, 2012

(54) COATING INSTRUMENT

(75) Inventors: Atsushi Hayashi, Ogaki (JP); Tsutomu Fukuda, Anpachi-gun (JP); Katsuyuki Fujimura, Yokohama (JP)

(73) Assignee: Mitsubishi Materials Corporation, Tokyo (JP)

( * ) Notice: Subject to any disclaimer, the term of this patent is extended or adjusted under 35 U.S.C. 154(b) by 267 days.

(21) Appl. No.: 12/585,477

(22) Filed: Sep. 16, 2009

(65) Prior Publication Data

US 2010/0162953 A1 Jul. 1, 2010

(51) Int. Cl.
*B05C 11/00* (2006.01)
*B05C 3/02* (2006.01)

(52) U.S. Cl. ..... 118/692; 118/410; 118/665; 118/667

(58) Field of Classification Search ..... 118/410, 118/419, 692, 683, 412, 665–667, 712; 427/8, 427/9, 356

See application file for complete search history.

(56) References Cited

U.S. PATENT DOCUMENTS 4,665,723 A * 5/1987 Zimmer ..... 68/200
5,766,357 A * 6/1998 Packer et al. ..... 118/420

FOREIGN PATENT DOCUMENTS

JP 09-131561 A 5/1997
JP 3501159 11/2004

* cited by examiner

*Primary Examiner* — Yewebdar Tadesse
(74) *Attorney, Agent, or Firm* — Edwards Wildman Palmer LLP; James E. Armstrong, IV; Nicholas J. DiCeglie, Jr.

(57) ABSTRACT

The coating instrument is provided with a coating head which has a plurality of head members, and in which a groove-like slot is formed, an adjustment unit accommodated in a recessed groove installed on a leading end face continuing to an outer face opposite to an inner face or to the inner face in the head member to adjust the width of the slot by pressing a side wall face of the recessed groove, and a controller for controlling a pressing force to the side wall face of the recessed groove by the adjustment unit. The adjustment unit is provided with a fluid pressure chamber into which a fluid is sealed, a pressing portion for pressing the side wall face of the recessed groove by the fluid pressure of the fluid pressure chamber, and an operating portion for allowing the fluid pressure of the fluid pressure chamber to change. The controller is provided with a pressure detecting portion for detecting the fluid pressure of the fluid pressure chamber and an instruction portion for comparing the fluid pressure detected by the pressure detecting portion with a previously-set pressure range to give instructions to the operating portion.

8 Claims, 7 Drawing Sheets

COATING INSTRUMENT

BACKGROUND OF THE INVENTION

1. Field of the Invention

The present invention relates to a coating instrument which is used in coating a coating solution on the surface of a member to be coated such as a sheet-like member or a panel-like member.

2. Description of the Related Art

Conventionally, as a coating instrument attached to a coating apparatus for coating a coating solution thinly and uniformly on the surface of a sheet-like member or a panel-like member to form a film layer, there is proposed, for example, that which is provided with a coating head constituted with a pair of head members in which between mutually opposing inner faces of the pair of head members, a pocket to which the coating solution is supplied and a groove-like slot which extends from the pocket to the leading edge of the coating head to open at the leading edge thereof are formed.

In the above-described coating instrument, the coating head is arranged in such a manner that the coating head opposes the sheet-like member (a member to be coated) and also that the longitudinal direction of the coating head is in alignment with the width direction of the sheet-like member, thereby coating the coating solution on the sheet-like member to form a film. Alternatively, the coating head is arranged above the panel-like member (a member to be coated), with the leading edge thereof pointed below, then, while the coating head is brought into contact with the panel-like member, the coating head is allowed to move, thereby coating the coating solution on the panel-like member to form a film.

Coating solutions to be coated by using a coating instrument equipped with the above-described coating head include a color paste for liquid crystal display and a resist agent for color filters. In this instance, uniform coating of a coating solution during coating work is important in terms of stable film formation on a sheet-like member or a panel-like member, which necessitates an accurate adjustment of the width of a slot of the coating head.

In this respect, Japanese Published Unexamined Patent Application No. 9-131561 and Japanese Patent No. 3501159 have proposed coating instruments equipped with an adjuster for adjusting the width of a slot. In these coating instruments, the width of the slot is adjusted in advance by the adjuster, thereby a coating solution is coated stably.

Meanwhile, in conventional coating instruments, there is a case where, even if the width of a slot is set to be a predetermined value at the time of initial use, the slot varies in width with the lapse of time, resulting in an inability to coat a coating solution stably. In this instance, in order to return the width of the slot to the predetermined value, it is necessary to interrupt coating work temporarily for readjustment of the width of the slot. This poses a problem in that the work is greatly reduced in efficiency.

In view of the above situation, a coating instrument capable of automatically controlling the width of a slot is strongly desired. However, this coating instrument is unable to continuously measure the width of the slot during coating work. Thus, no information is available about variation in the width of the slot, thus making it very difficult to automatically control the width of the slot.

The present invention has been made in view of the above situation, an object of which is to provide a coating instrument capable of automatically controlling the width of a slot.

SUMMARY OF THE INVENTION

The coating instrument of the present invention is provided with a coating head which has a plurality of head members, and in which a groove-like slot opened at the leading edge of a head to extend in the longitudinal direction of the head member is formed between mutually opposing inner faces of these plurality of head members, an adjustment unit accommodated in a recessed groove installed on the head member to adjust the width of the slot by pressing a side wall face of the recessed groove, and a controller for controlling a pressing force to the side wall face of the recessed groove by the adjustment unit. The adjustment unit is provided with a fluid pressure chamber into which a fluid is sealed, a pressing portion for pressing the side wall face of the recessed groove by the fluid pressure of the fluid pressure chamber, and an operating portion for allowing the fluid pressure of the fluid pressure chamber to change. The controller is provided with a pressure detecting portion for detecting the fluid pressure of the fluid pressure chamber and an instruction portion for comparing the fluid pressure detected by the pressure detecting portion with a previously-set pressure range to give instructions to the operating portion.

In the coating instrument of the present invention, a recessed groove is installed on a head member which forms a slot. And an adjustment unit for pressing a side wall face of the recessed groove to adjust the width of the slot is accommodated inside the recessed groove. The adjustment unit is provided with a fluid pressure chamber into which a fluid is sealed and a pressing portion for pressing the side wall face of the recessed groove by the fluid pressure of the fluid pressure chamber. Thereby, when the slot is changed in width, the pressing portion undergoes a positional displacement according to displacement of the side wall face of the recessed groove, resulting in a change in fluid pressure of the fluid pressure chamber. It is possible to detect a change in width of the slot by detecting the fluid pressure inside the fluid pressure chamber.

Then, the controller for controlling a pressing force to the side wall face of the recessed groove by the adjustment unit is provided with a pressure detecting portion for detecting the fluid pressure inside the fluid pressure chamber and an instruction portion for comparing the fluid pressure detected by the pressure detecting portion with a previously-set pressure range to give instructions to the operating portion. The instruction portion gives instructions to the operating portion so that the fluid pressure of the fluid pressure chamber falls within the set pressure range. It is, thereby, possible to automatically control the width of the slot.

In the coating instrument of the present invention, the operating portion may be provided with a piston for compressing a fluid sealed inside the fluid pressure chamber and a driving portion for driving the piston back and forth freely.

In this instance, the instruction portion compares the fluid pressure inside the fluid pressure chamber with the set pressure range, thereby giving the operating portion instructions regarding the amount that the piston moves back and forth. Thereby, the fluid pressure chamber can be changed in volume to adjust the fluid pressure. Thus, a pressing force to the side wall face of the recessed groove by the adjustment unit can be controlled to adjust the width of the slot.

In the coating instrument of the present invention, the adjustment unit can be moved and fixed to any position inside the recessed groove in the longitudinal direction.

In this instance, it is possible to dispose the adjustment unit at a position in the longitudinal direction at which the slot may easily change in width with the lapse of time depending on the usage. And it is also possible to control automatically the width of the slot with high accuracy.

The coating instrument of the present invention may be also provided with a measurement device for measuring at least any one of film thickness, temperature and flow volume of a coating solution ejected from the slot, the width of the slot, and a distance between an opening of the slot and an object to be coated, and a correction device for correcting the set pressure range at the instruction portion on the basis of a measured value by the measurement device.

The set pressure range is corrected on the basis of at least any one of measured values selected from those of film thickness, temperature and flow volume of a coating solution ejected from the slot, the width of the slot, and a distance between an opening of the slot and an object to be coated. It is, thereby, possible to adjust the width of the slot more accurately. In addition, measurement by the measurement device is not required to be made in real time but may be made at certain intervals to correct the set pressure range.

According to the present invention, a coating instrument capable of automatically controlling the width of a slot is provided.

DESCRIPTION OF PREFERRED EMBODIMENTS

Figure 1:
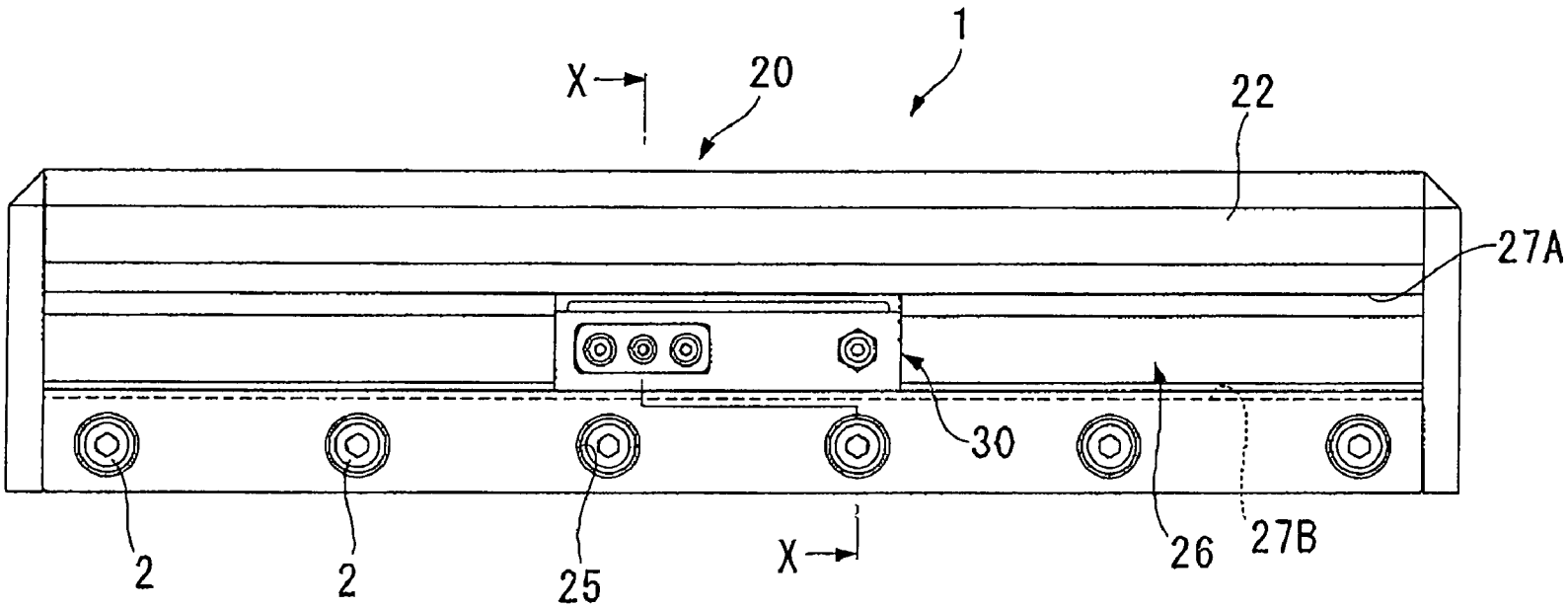
FIG. 1 is a side view of a coating head used in a coating instrument which is a first embodiment of the present invention.
Figure 2:
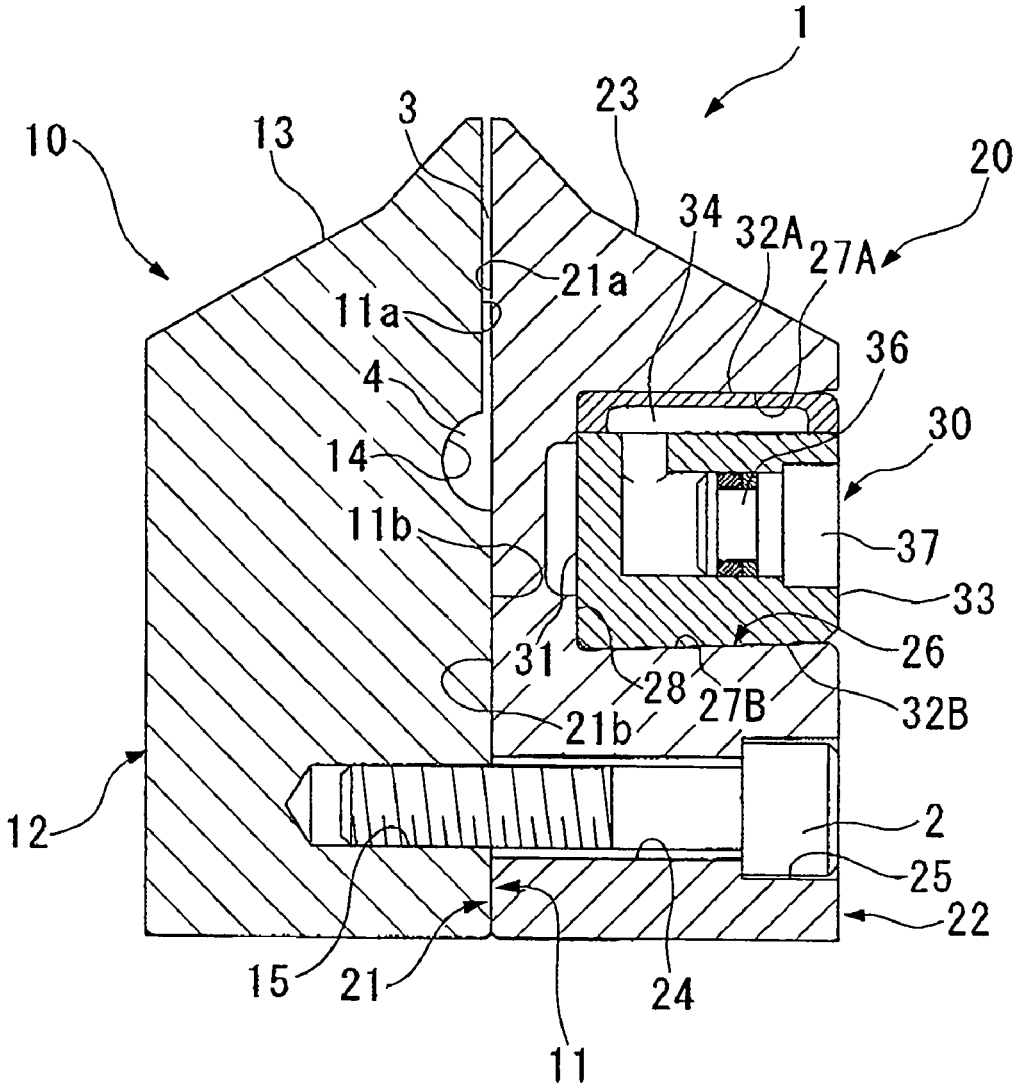
FIG. 2 is a cross-sectional view taken along line X to X in FIG. 1.
Figure 3:
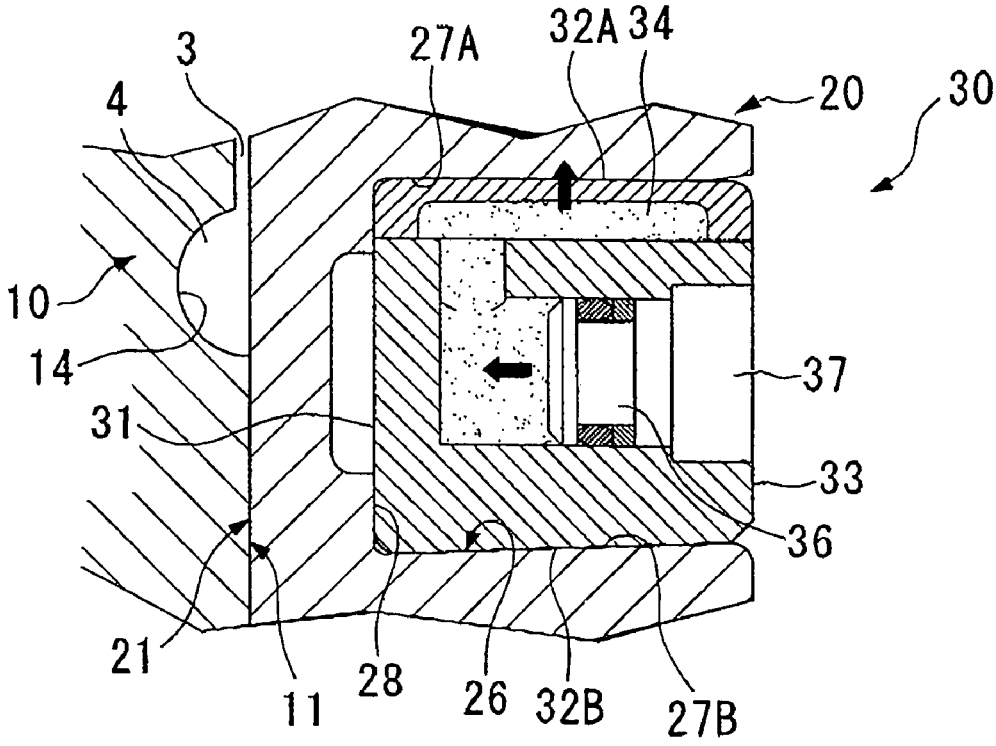
FIG. 3 is an enlarged view showing an adjustment unit shown in FIG. 2.

A description will be given of embodiments of the present invention by referring to attached drawings. FIG. 1 and FIG. 2 show a coating head 1 equipped on a coating instrument which is an embodiment of the present invention. Further, FIG. 3 shows an adjustment unit 30 disposed at the coating head 1.

The coating head 1 is constituted so as to include a pair of head members 10, 20 extending in the longitudinal direction (the lateral direction in FIG. 1).

In the first head member 10, an area at the leading edge of the coating head 1 (the upper side in FIG. 1 and FIG. 2) on an inner face 11 facing the second head member 20 is given as a slot face 11*a*, and an area at the base edge of the coating head 1 (the lower side in FIG. 1 and FIG. 2) is given as a contact face 11*b*. Between the slot face 11*a* and the contact face 11*b*, a pocket groove 14 extending in the longitudinal direction to have a semicircular cross section is formed.

In this instance, the slot face 11*a* and the contact face 11*b* are arranged in parallel with each other, and the slot face 11*a* is slightly retreated outwardly (a direction spaced away from the second head member 20) from the contact face 11*b*.

Further, the first head member 10 is provided with a plurality of bolt holes 15 (six holes in the present embodiment) opened on the contact face 11*b* to extend in a direction orthogonal to the contact face 11*b*, with certain intervals kept in the longitudinal direction.

In the second head member 20, an inner face 21 facing the first head member 10 is formed uniformly flat, a part opposing the slot face 11*a* of the first head member 10 is given as a slot face 21*a*, and a part in contact with the contact face 11*b* of the first head member 10 is given as a face to be in contact 21*b*. Further, the second head member 20 is provided with bolt insertion holes 24 (six holes in this embodiment) opened on the face to be in contact 21*b* to extend in a direction orthogonal to the face to be in contact 21*b* through the second head member 20, with certain intervals kept in the longitudinal direction. Regarding the bolt insertion hole 24, a counter bore 25 which is one-size larger in diameter than the bolt insertion hole 24 is installed at a part opened on the outer face 22 of the second head member 20.

The pair of head members 10, 20 are arranged so as to oppose each other and also in such a manner that the contact face 11*b* of the first head member 10 and the face to be in contact 21*b* of the second head member 20 are closely attached to each other. Thereby, the axis line of the bolt hole 15 is in alignment with that of the bolt insertion hole 24.

First, a joining bolt 2 inserted into the bolt insertion hole 24 is screwed into the bolt hole 15, thereby fastening the pair of head members 10, 20. Next, a slight gap is formed between the slot face 11*a* of the first head member 10 and the slot face 21*a* of the second head member 20, by which a slot 3 opened at the leading edge of the coating head 1 is formed. Then, a pocket 4 is formed with the pocket groove 14 and the inner face 21 of the second head member 20.

The slot 3 and the pocket 4 are formed so as to extend in the longitudinal direction of the head members 10, 20, and a rear end part of the slot 3 is communicatively connected to the pocket 4.

The leading edge face 13 of the head member 10 is given as an inclined face protruding to the leading edge of the head member 10, as the leading edge face 13 moves from the outer face 12 to the inner face 11, as shown in FIG. 2, on a cross section orthogonal to the longitudinal direction of the head member 10, and a part of the slot 3 is in such a shape as to further protrude at the leading edge. Further, the leading edge face 23 of the head member 20 is given as an inclined face protruding at the leading edge of the head member 20, as the leading edge face 23 moves from the outer face 22 to the inner face 21, and a part of the slot 3 is in such a shape as to further protrude at the leading edge.

Then, a recessed groove 26 which is recessed in a direction orthogonal to the outer face 22 is installed on the outer face 22 of the second head member 20 in such a manner as to extend in the longitudinal direction. The recessed groove 26 has a U-shaped cross section and is provided with a pair of side wall faces 27A, 27B and a bottom face 28. The recessed groove 26 is installed, by which the slot face 21*a* of the second head member 20 is made thinner at the rear end part thereof.

Further, the pair of side wall faces 27A, 27B are inclined to each other so that a distance between the pair of side wall faces 27A, 27B (a distance in a direction at which the slot 3 extends) is made gradually shorter as they move to an opening part of the recessed groove 26 (the outer face 22).

As shown in FIG. 2 and FIG. 3, an adjustment unit 30 formed approximately in a rectangular solid extending in the longitudinal direction of the coating head 1 is inserted into the recessed groove 26.

The adjustment unit 30 is provided with a pair of pressing faces 32A, 32B respectively closely attached to the pair of side wall faces 27A, 27B of the recessed groove 26, a back face 31 in contact with the bottom face 28 of the recessed groove 26 and a front face 33 adjacent to an opening part of the recessed groove 26.

Further, the pair of pressing faces 32A, 32B of the adjustment unit 30 are inclined to each other so that a distance between the pair of pressing faces 32A, 32B (a distance in a direction at which the slot 3 extends) is made gradually shorter as they move to the front face 33. Therefore, the adjustment unit 30 is allowed to move inside the recessed groove 26 along the longitudinal direction of the recessed groove 26 but will not fall out from the opening part of the recessed groove 26.

In the adjustment unit 30, a fluid pressure chamber 34 where oil as a fluid is sealed inside a part including the first pressing face 32A facing the leading edge of the coating head 1, of the pair of pressing faces 32A, 32B facing a direction at which the slot 3 extends is formed. The presence of the fluid pressure chamber 34 makes it possible to reduce the thickness of the part including the first pressing face 32A, and the part is then able to undergo an elastic deformation.

In the adjustment unit 30, an operating portion 35 which allows the fluid pressure (hydraulic pressure in the present embodiment) inside the fluid pressure chamber 34 to change is installed. The operating portion 35 is provided with a piston 36 for adjusting a volume of the fluid pressure chamber 34 and a driving portion 37 for driving the piston 36 back and forth. In the present embodiment, the driving portion 37 is provided with a motor 38 and a gear 39 for converting rotational motion of the motor 38 to linear motion. The motor 38 is driven rotationally, by which the piston 36 can be moved back and forth.

The coating instrument also has a controller 40 for controlling a pressing force to the side wall face 27A of the recessed groove 26 by the adjustment unit 30.

Figure 4:
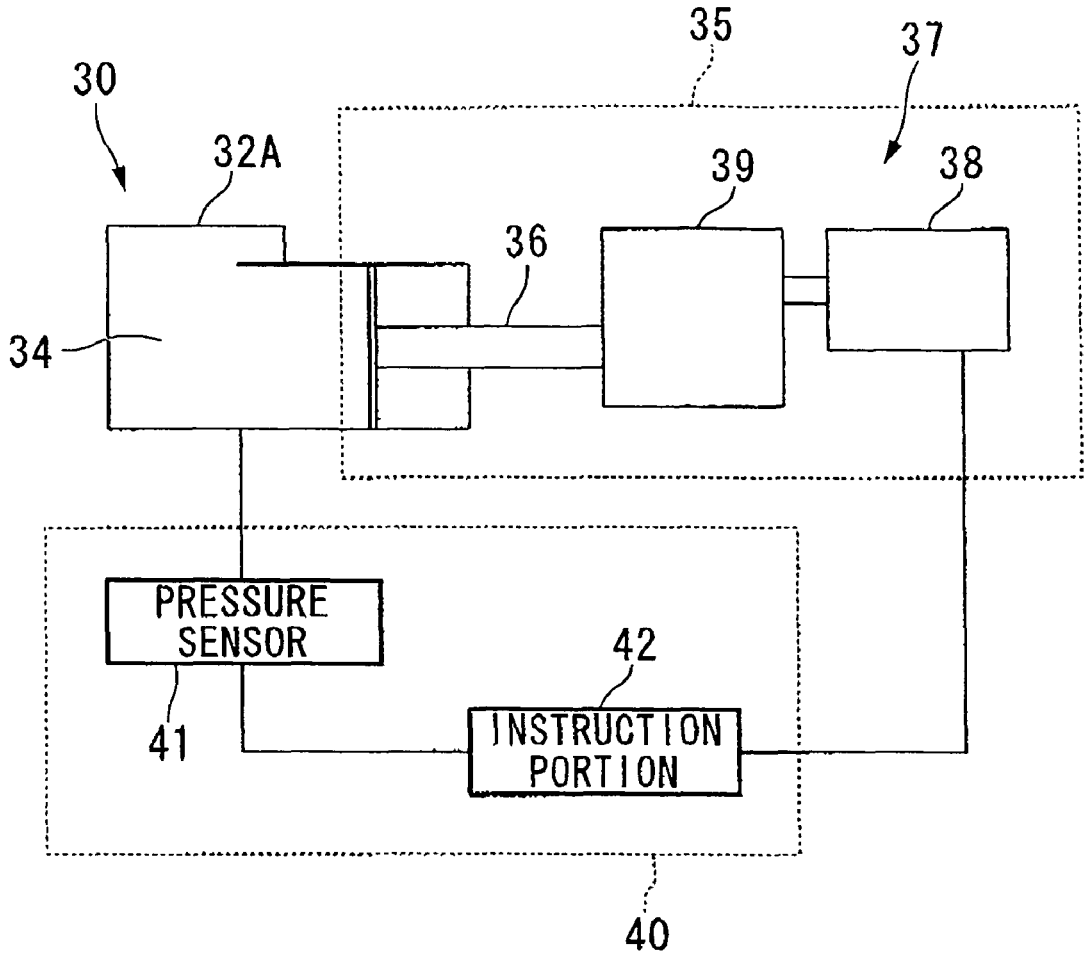
FIG. 4 is a block diagram of the coating instrument shown in FIG. 1.

As shown in FIG. 4, the controller 40 is provided with a pressure sensor 41 for detecting the fluid pressure (hydraulic pressure) of the fluid pressure chamber 34 and an instruction portion 42 for giving instructions to the motor 38 of the operating portion 35 on the basis of a fluid pressure P detected by the pressure sensor 41. The instruction portion 42 has a previously-set pressure range according to the width of the slot 3 and is constituted so as to compare the set pressure range with the fluid pressure P detected by the pressure sensor 41, giving the motor 38 instructions to make the fluid pressure P within the set pressure range, thereby allowing the piston 36 to move back and forth.

In the coating instrument equipped with the above-constituted coating head 1, the slot 3 is adjusted for the width in advance to provide a pressure range set according to the width of the slot 3. After such adjustment of the width of the slot 3, the coating instrument is attached to a coating apparatus and used in coating work. In the coating work, when a coating solution is supplied into the coating head 1 through a supply port (not illustrated) from the coating apparatus, the coating solution is filled into the pocket 4, spread in the longitudinal direction of the coating head 1, ejected from the leading edge of the coating head 1, that is, an opening of the slot 3 through the slot 3 communicatively connected to the pocket 4, thereby coated on the surface of a member to be coated which moves in relation to the coating head 1.

Where the slot 3 undergoes a change in the width during the coating work, the first side wall face 27A of the recessed groove 26 also moves to a direction at which the slot 3 extends. In association with this movement, the pressing face 32A closely attached to the first side wall face 27A undergoes an elastic deformation to change the volume of the fluid pressure chamber 34, by which the fluid pressure P (hydraulic pressure) of the fluid pressure chamber 34 is changed. The fluid pressure P of the fluid pressure chamber 34 is monitored by using the pressure sensor 41, thus making it possible to detect the change in the width of the slot 3 in real time.

Figure 5:
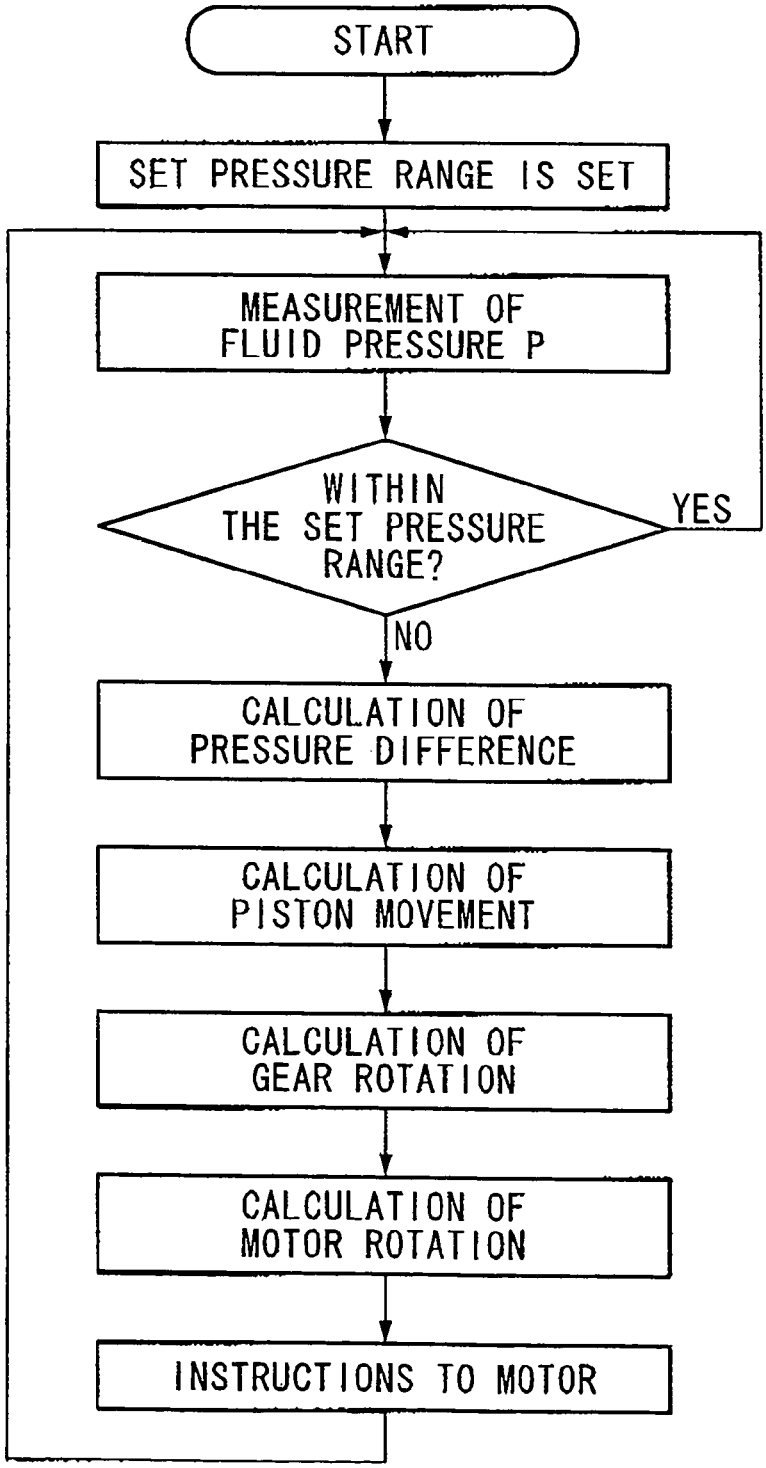
FIG. 5 is a flowchart showing a controller equipped on the coating instrument shown in FIG. 1.

A description will be given of automatic control of the slot 3 in the coating, instrument by referring to the flowchart shown in FIG. 5.

The fluid pressure P of the fluid pressure chamber 34 is monitored by the pressure sensor 41 in real time to compare the fluid pressure P with a previously-set pressure range. Then, where the fluid pressure P is in excess of the previously-set pressure range; the instruction portion 42 gives instructions to the motor 38, allowing the piston 36 to move back and forth by a predetermined amount, and making adjustment so that the fluid pressure P falls within the set pressure range. Thereby, the slot 3 is given a predetermined width.

According to the coating instrument of the present invention, the recessed groove 26 extending in the longitudinal direction is installed on the outer face 22 of the second head member 20 equipped with the slot face 21*a* which forms the slot 3. The adjustment unit 30 for adjusting the width of the slot 3 by pressing the side wall face 27A of the recessed groove 26 is accommodated inside the recessed groove 26. Therefore, it is possible to adjust the width of the slot 3 accurately by using the adjustment unit 30.

The operating portion 35 also has the piston 36 for compressing oil sealed inside the fluid pressure chamber 34 and the driving portion 37 for driving the piston 36 back and forth freely, thereby controlling the rotation of the motor 38 to adjust an amount that the piston 36 moves back and forth. A change in the amount that the piston 36 moves back and forth results in a change in the volume of the fluid pressure chamber 34, thus making it possible to adjust the fluid pressure P. Thereby, a pressing force to the side wall face 27A of the recessed groove 26 by the adjustment unit 30 is controlled, making it possible to accurately adjust the width of the slot 3.

The controller 40 for controlling the pressing force to the side wall face 27A of the recessed groove 26 by the adjustment unit 30 is also provided with a pressure sensor 41 for detecting a fluid pressure P inside the fluid pressure chamber 34, and an instruction portion 42 for comparing the fluid pressure P detected by the pressure sensor 41 with a previously-set pressure range to give instructions to the operating portion 35. The instruction portion 42 gives the operating portion 35 instructions so that the fluid pressure P of the fluid pressure chamber 34 falls within the set pressure range. Thereby, it is possible to automatically control the width of the slot 3.

Further, the above-described adjustment unit 30 can be moved and fixed to any given position inside the recessed groove 26 in the longitudinal direction. Therefore, it is possible to dispose the adjustment unit 30 at a position in the longitudinal direction at which the slot 3 may easily change in width with the lapse of time depending on the usage. And it is also possible to control automatically the width of the slot 3 with high accuracy.

Next, a description will be given of the second embodiment of the present invention. In addition, the same constituents as those of the first embodiment will be given the same reference numerals and a detailed description is omitted.

Figure 6:
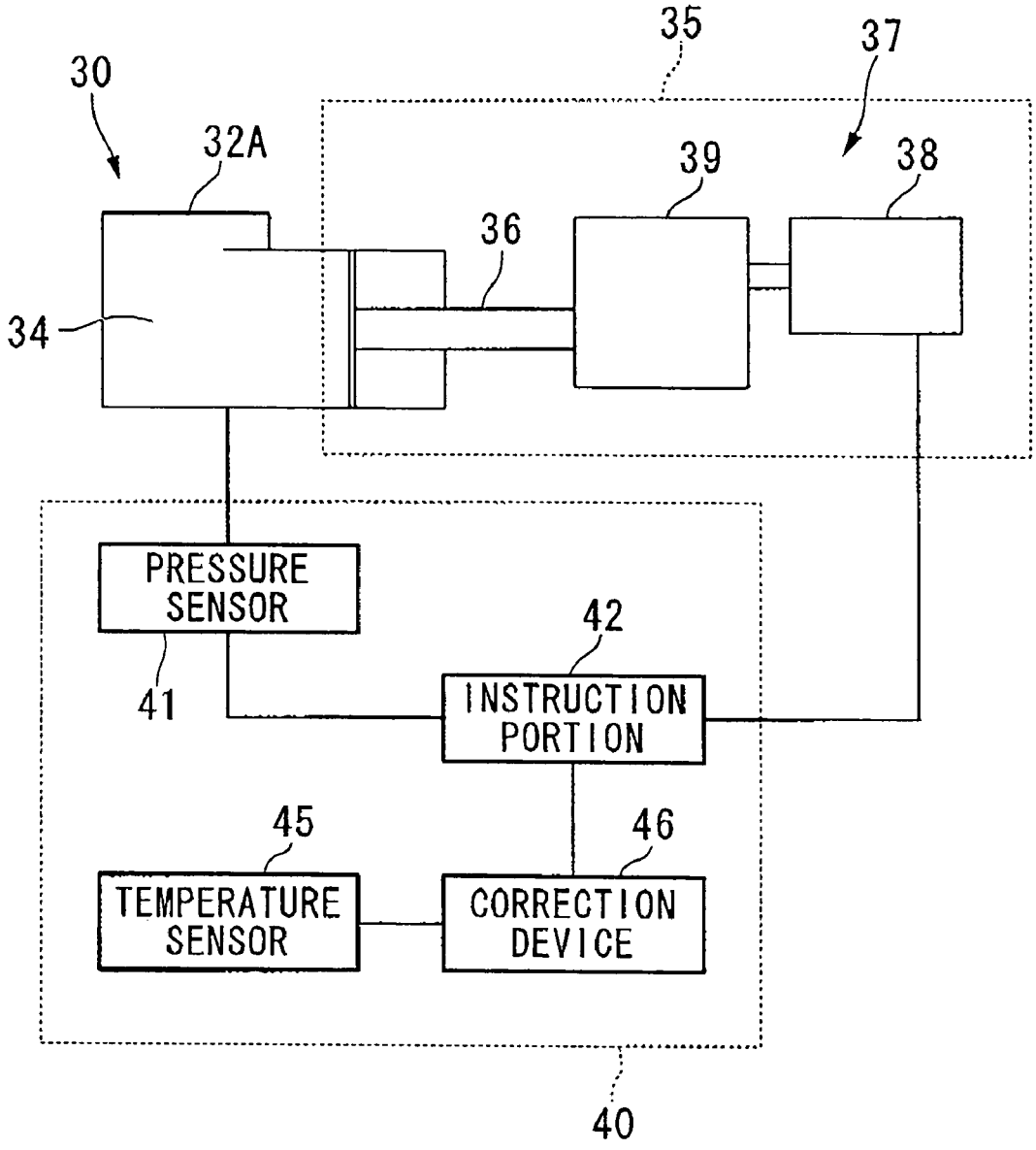
FIG. 6 is a block diagram showing a coating instrument which is a second embodiment of the present invention.

As shown in FIG. 6, the controller 40 in the coating instrument of the second embodiment is provided with a temperature sensor 45 for measuring the temperature of a coating solution, and a correction device 46 for correcting the set pressure range on the basis of a measured value by the temperature sensor 45.

Figure 7:
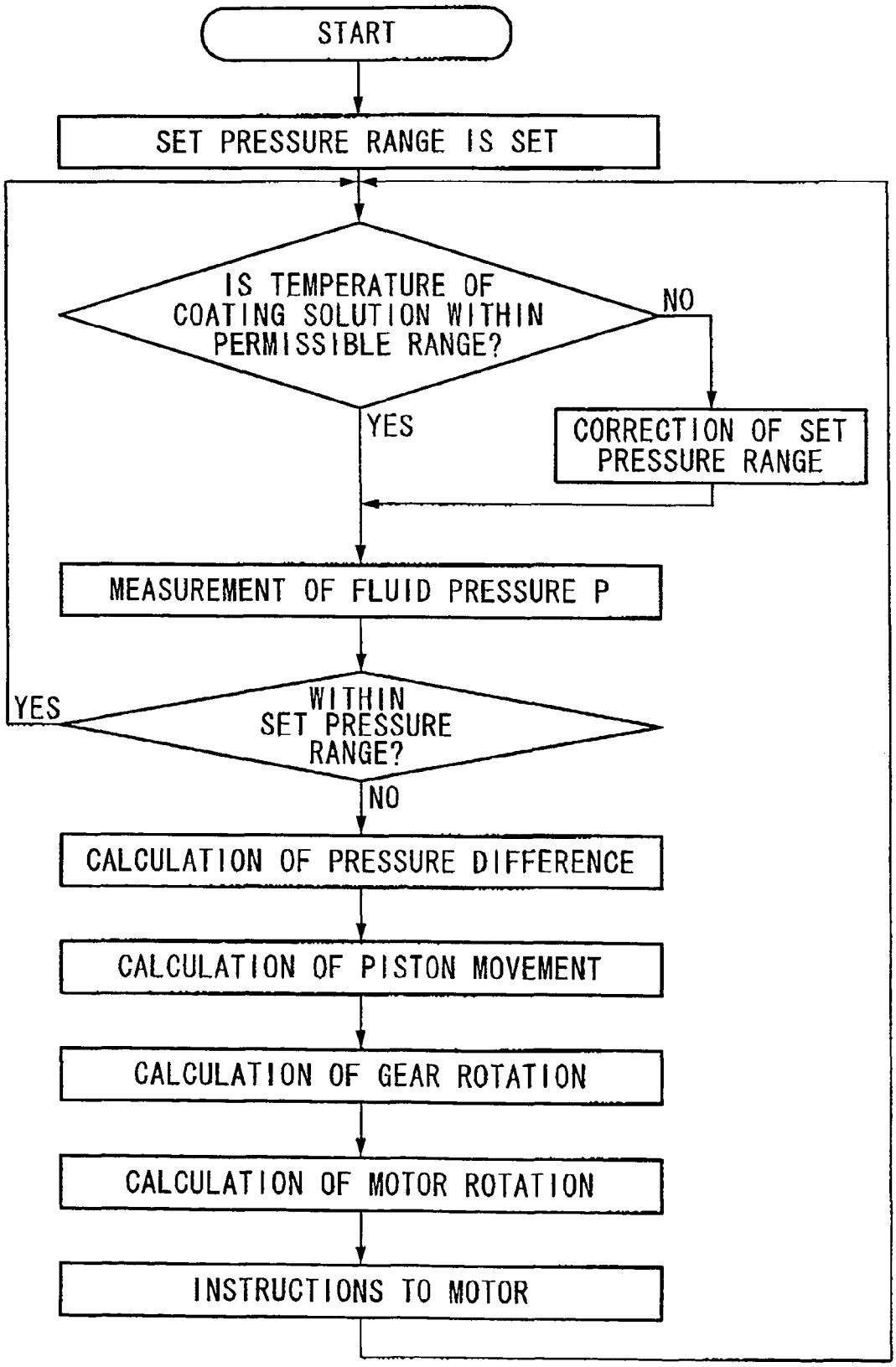
FIG. 7 is a flowchart showing a controller equipped on the coating instrument shown in FIG. 6.

A description will be given of automatically controlling the width of the slot 3 in the coating instrument by referring to the flowchart shown in FIG. 7.

The fluid pressure P inside the fluid pressure chamber 34 is monitored in real time by the pressure sensor 41 and also the coating solution passing through the slot 3 is measured for temperature by the temperature sensor 45. In addition, measurement by the temperature sensor 45 may be made not in real time but at certain intervals. In this instance, where the coating solution is in excess of a permissible temperature range, the correction device 46 is used to correct the set pressure range. Then, the fluid pressure P is compared with the thus corrected set pressure range. Where the fluid pressure P is in excess of the set pressure range, the instruction portion 42 gives instructions to the motor 38, allowing the piston 36 to move back and forth by a predetermined amount, thereby making adjustment so that the fluid pressure P falls within the set pressure range.

In the coating instrument of the second embodiment, the set pressure range is corrected by the correction device 46 according to the temperature of the coating solution, thus making it possible to adjust the width of the slot 3.

In this instance, there is a case where the coating solution ejected from an opening of the slot 3 may vary in film thickness, depending on a change in temperature of the coating solution. In such a case, the width of the slot 3 is changed according to the temperature of the coating solution. It is, thereby, possible to perform coating work stably, with the film thickness kept constant.

A description has been given so far of embodiments of the present invention, however, the present invention shall not be limited thereto, but may be modified in any way within a scope not departing from technical ideas of the present invention.

An explanation was given of ah example where the recessed groove is formed on the outer face of the second head member, to which the present invention shall not be limited. The recessed groove may be formed on the leading edge face of the second head member.

An explanation was also given of an example where the coating head is constituted of two head members, to which the present invention shall not be limited. The coating head may be constituted of three or more head members. In this instance, the recessed groove may be formed at least on one of the head members at both ends of the coating head in a direction orthogonal to the longitudinal direction, and the adjustment unit may be disposed.

Further, in the second embodiment, the coating instrument of the present invention is provided with a temperature sensor for measuring temperature of a coating solution, and a correction device for correcting the set pressure range on the basis of a measured value by the temperature sensor. However, the coating instrument of the present invention may be provided with a measurement device for measuring at least any one of film thickness, temperature and flow volume of a coating solution, the width of the slot, and a distance between an opening of the slot and an object to be coated, and a correction device for correcting the set pressure range on the basis of a measured value by the measurement device.

What is claimed is:

1. A coating instrument comprising:

a coating head which has a plurality of head members, and in which a slot opened at a leading edge of the head members to extend in the longitudinal direction of the head members is formed between mutually opposing inner faces of these plurality of head members;

an adjustment unit accommodated in a recessed groove installed on one of the plurality of head members to adjust the width of the slot by pressing a side wall face of the recessed groove; and a controller configured to automatically control a pressing force to the side wall face of the recessed groove by the adjustment unit; wherein the adjustment unit is provided with a fluid pressure chamber into which a fluid is sealed, a pressing portion for pressing the side wall face of the recessed groove by the fluid pressure of the fluid pressure chamber, and an operating portion for allowing the fluid pressure of the fluid pressure chamber to change, and the controller is provided with a pressure detecting portion for detecting the fluid pressure of the fluid pressure chamber and an instruction portion for comparing the fluid pressure detected by the pressure detecting portion with a previously-set pressure range to give instructions to the operating portion.

2. The coating instrument according to claim 1, wherein the operating portion is provided with a piston for compressing a fluid sealed inside the fluid pressure chamber and a driving portion for driving the piston back and forth freely.

3. The coating instrument according to claim 2 which is provided with a measurement device for measuring at least any one of film thickness, temperature and flow volume of a coating solution ejected from the slot, the width of the slot, and a distance between an opening of the slot and an object to be coated, and a correction device for correcting the set pressure range on the basis of a measured value by the measurement device.

4. The coating instrument according to claim 1, wherein the adjustment unit can be moved and fixed to any position inside the recessed groove in the longitudinal direction.

5. The coating instrument according to claim 4 which is provided with a measurement device for measuring at least any one of film thickness, temperature and flow volume of a coating solution ejected from the slot, the width of the slot, and a distance between an opening of the slot and an object to be coated, and a correction device for correcting the set pressure range on the basis of a measured value by the measurement device.

6. The coating instrument according to claim 2, wherein the adjustment unit can be moved and fixed to any position inside the recessed groove in the longitudinal direction.

7. The coating instrument according to claim 6 which is provided with a measurement device for measuring at least any one of film thickness, temperature and flow volume of a coating solution ejected from the slot, the width of the slot, and a distance between an opening of the slot and an object to be coated, and a correction device for correcting the set pressure range on the basis of a measured value by the measurement device.

8. The coating instrument according to claim 1 which is provided with a measurement device for measuring at least any one of film thickness, temperature and flow volume of a coating solution ejected from the slot, the width of the slot, and a distance between an opening of the slot and an object to be coated, and a correction device for correcting the set pressure range on the basis of a measured value by the measurement device.

* * * * *